US009051668B2

(12) United States Patent
Lonati et al.

(10) Patent No.: US 9,051,668 B2
(45) Date of Patent: Jun. 9, 2015

(54) CIRCULAR HOSIERY KNITTING MACHINE OF THE SEAMLESS TYPE WITH HIGH STITCH FORMING PRECISION

(75) Inventors: Ettore Lonati, Botticino (IT); Fausto Lonati, Brescia (IT); Tiberio Lonati, Brescia (IT)

(73) Assignee: SANTONI S.p.A., Brescia (IT)

( * ) Notice: Subject to any disclaimer, the term of this patent is extended or adjusted under 35 U.S.C. 154(b) by 0 days.

(21) Appl. No.: 14/002,513

(22) PCT Filed: Feb. 28, 2012

(86) PCT No.: PCT/IB2012/050932

§ 371 (c)(1),
(2), (4) Date: Aug. 30, 2013

(87) PCT Pub. No.: WO2012/117352

PCT Pub. Date: Sep. 7, 2012

(65) Prior Publication Data

US 2013/0333423 A1 Dec. 19, 2013

(30) Foreign Application Priority Data

Mar. 1, 2011 (IT) ..... MI2011A0315

(51) Int. Cl.
*D04B 15/06* (2006.01)
*D04B 15/34* (2006.01)
*D04B 15/32* (2006.01)

(52) U.S. Cl.
CPC ..... *D04B 15/34* (2013.01); *D04B 15/322* (2013.01)

(58) Field of Classification Search
CPC ..... D04B 15/34; D04B 15/322
USPC ..... 66/108 R, 115, 107, 104, 106, 108 A, 66/217
See application file for complete search history.

(56) References Cited

U.S. PATENT DOCUMENTS 3,318,113 A * 5/1967 Nebel ..... 66/108 R
3,783,645 A * 1/1974 Bianchi ..... 66/108 R
(Continued)

FOREIGN PATENT DOCUMENTS

CN 1648310 A 8/2005
CN 1742125 A 3/2006
(Continued)

OTHER PUBLICATIONS

International Search Report dated Jun. 5, 2012 issued in PCT/IB2012/050932.
(Continued)

*Primary Examiner* — Danny Worrell
(74) *Attorney, Agent, or Firm* — Scully, Scott, Murphy & Presser, P.C.

(57) ABSTRACT

A circular hosiery knitting machine of the seamless type, comprising a supporting structure and a needle cylinder provided with a plurality of axial slots, each of which accommodates a needle which can be actuated with a reciprocating motion along the corresponding axial slot; a sinker ring being arranged around the upper end of the needle cylinder being provided with a plurality of radial slots, each of which accommodates a sinker, which can move with a reciprocating motion along the corresponding radial slot, each sinker being provided with a heel which protrudes upward from the corresponding radial slot and can engage at least one path defined in a sinker cover which faces in an upper region the sinker ring, the needle cylinder being actuatable with a rotary motion about its own axis with respect to the supporting structure and to the sinker cover.

9 Claims, 11 Drawing Sheets

(56) References Cited

U.S. PATENT DOCUMENTS

| | | | | |
|---|---|---|---|---|
| 4,156,356 | A * | 5/1979 | Holder | 66/108 R |
| 4,571,957 | A * | 2/1986 | Engelfried et al. | 66/115 |
| 7,055,346 | B2 * | 6/2006 | Lonati et al. | 66/108 R |
| 2005/0183462 | A1 * | 8/2005 | Lonati et al. | 66/8 |

FOREIGN PATENT DOCUMENTS

| | | | |
|---|---|---|---|
| CN | 200946187 | Y | 9/2007 |
| CN | 201158740 | Y | 12/2008 |
| DE | 32 46 653 | A1 | 7/1983 |
| EP | 0 281 168 | A1 | 9/1988 |
| GB | 442836 | | 2/1936 |
| WO | WO 03/100147 | A1 | 12/2003 |

OTHER PUBLICATIONS

Chinese Office Action dated Jun. 26, 2014 received from related Application No. 201280011124.9, together with a partial English-language translation.

* cited by examiner

CIRCULAR HOSIERY KNITTING MACHINE OF THE SEAMLESS TYPE WITH HIGH STITCH FORMING PRECISION

The present invention relates to a circular hosiery knitting machine of the seamless type with high stitch forming precision.

As is known, in hosiery knitting machines the knockover sinkers, commonly termed sinkers, cooperate with the needles in forming stitches. The sinkers are arranged between the needles of the machine and have the function of defining a resting surface for the yarn supplied to the needles while they are forming a new loop of knitting and then of tensioning the loop of knitting against the shank of the needle while it is being moved to pick up the yarn in order to form a new loop of knitting, so as to produce assuredly the opening of the tab or tongue of the needle while the old loop of knitting is lowered on the shank of the needle.

In circular hosiery knitting machines, the sinkers are accommodated individually inside a radial slot defined in the sinker ring, which is fixed coaxially to the needle cylinder proximate to its upper end. Each sinker is arranged between two contiguous needles and is provided with at least one heel which protrudes upward from the corresponding slot of the sinker ring. Such heel engages in paths defined by cams which are connected to a sinker cover which faces the sinker ring in an upward region. The paths defined by such cams are shaped so as to produce, as a consequence of the actuation of the needle cylinder with a rotary motion about its own axis with respect to the sinker cover, a movement of the sinkers along a radial direction, in the corresponding slot, with respect to the needle cylinder.

In medium-diameter circular machines for manufacturing knitted articles without lateral seams, also known as knitting machines of the seamless type, which, as is known, are derived conceptually from circular hosiery knitting machines, and in small-diameter circular machines for making socks and stockings, which provide tubular articles often with shapes obtained by varying the density of the knitting from one row to the next and sometimes even along a same row of knitting, there is the need to vary the actuation of the sinkers during the production of the article.

This need is met by providing at least part of the cams mounted in the sinker cover so that they can move by way of the action of actuators which can be actuated by the electronic control and monitoring element that supervises the operation of the machine and/or by providing the sinker cover so that it can be rotated, through arcs of preset extent, by way of other actuators, which also can be actuated by the control and monitoring element, so that the paths defined by the cams can be offset in advance or with a delay from one kind of knitting to another, according to the requirements.

Generally, in these types of machine the sinker cover rests on the sinker ring, with the optional interposition of bearings, so that the sinker ring can rotate, jointly with the needle cylinder, about the needle cylinder axis with respect to the sinker cover, which is connected, for example by means of the above mentioned actuators, to the supporting structure of the machine.

In practice, in these machines the sinker cover is supported by the needle cylinder and during the fine-tuning of the machine its position can be "centered" adequately with respect to the needle cylinder.

The centering of the sinker cover performed with respect to the needle cylinder suffers the drawback of not ensuring high precision, since the needle cylinder, being a constantly moving element, often with high rotation rates, during the operation of the machine can alter the position of the sinker cover also with respect to the needle cylinder proper.

Even small variations of the position of the sinker cover can cause unwanted variations of the tension of the stitches with respect to the tension that is preset in the program followed by the control and monitoring element that supervises the operation of the machine, thus reducing knitting precision.

These variations lead to the provision of products of poor quality and are intolerable in knitting that requires high precision and regularity in the formation of the stitches.

The aim of the present invention is to solve the above mentioned problem, by providing a circular hosiery knitting machine of the seamless type that ensures high knitting precision.

Within this aim, an object of the invention is to provide a machine that ensures high regularity in the formation of the stitches.

Another object of the invention is to provide a machine that simplifies fine-tuning operations.

Another object of the invention is to provide a machine that has high reliability in operation and can be manufactured with competitive costs.

This aim, as well as these and other objects which will become better apparent hereinafter, are achieved by a circular hosiery knitting machine of the seamless type, comprising a supporting structure and a needle cylinder which is oriented so that its axis is substantially vertical and is provided, on its lateral surface, with a plurality of axial slots, each of which accommodates a needle which can be actuated with a reciprocating motion along the corresponding axial slot; a sinker ring being arranged around the upper end of said needle cylinder, being coaxial to said needle cylinder and being provided with a plurality of radial slots, each of which accommodates a sinker, which can move with a reciprocating motion along the corresponding radial slot; each sinker being provided with a heel which protrudes upwardly from the corresponding radial slot and can engage at least one path defined in a sinker cover which faces in an upper region said sinker ring; said needle cylinder being actuatable with a rotary motion about its own axis with respect to said supporting structure and said sinker cover, characterized in that it comprises means for adjusting the position of said sinker cover on a plane which is substantially perpendicular to the axis of said needle cylinder, said adjustment means being interposed between said sinker cover and said supporting structure.

Further characteristics and advantages of the invention will become better apparent from the description of two preferred but not exclusive embodiments of the machine according to the invention, illustrated by way of non-limiting example in the accompanying drawings, wherein:

FIG. 1 is a top plan view of a portion of the machine, with some elements omitted for the sake of greater clarity;

FIG. 2 is a schematic sectional view of FIG. 1, taken along the line II-II;

FIG. 3 is a perspective view of an enlarged-scale detail of FIG. 2;

FIG. 4 is a schematic sectional view of FIG. 1, taken along the line IV-IV, FIG. 5 is a perspective view of an enlarged-scale detail of FIG. 4, with some elements omitted for the sake of greater clarity;

FIG. 6 is a schematic sectional view of FIG. 1, taken along the line VI-VI;

FIG. 7 is a perspective view of a portion of the machine according to the invention, with some elements omitted for the sake of greater clarity;

FIG. 8 is an enlarged-scale view of a detail of FIG. 7;

FIG. 9 is a perspective view of the same portion of the machine shown in FIG. 7, but viewed from a different angle;

FIG. 10 is an enlarged-scale view of a detail of FIG. 9;

FIG. 11 is a top plan view of the portion of machine shown in FIG. 7;

FIG. 12 is a sectional view of FIG. 11, taken along the line XII-XII;

FIG. 13 is a sectional view of FIG. 11, taken along the line XIII-XIII with the yarn guide assemblies omitted for the sake of simplicity.

Figure 1:
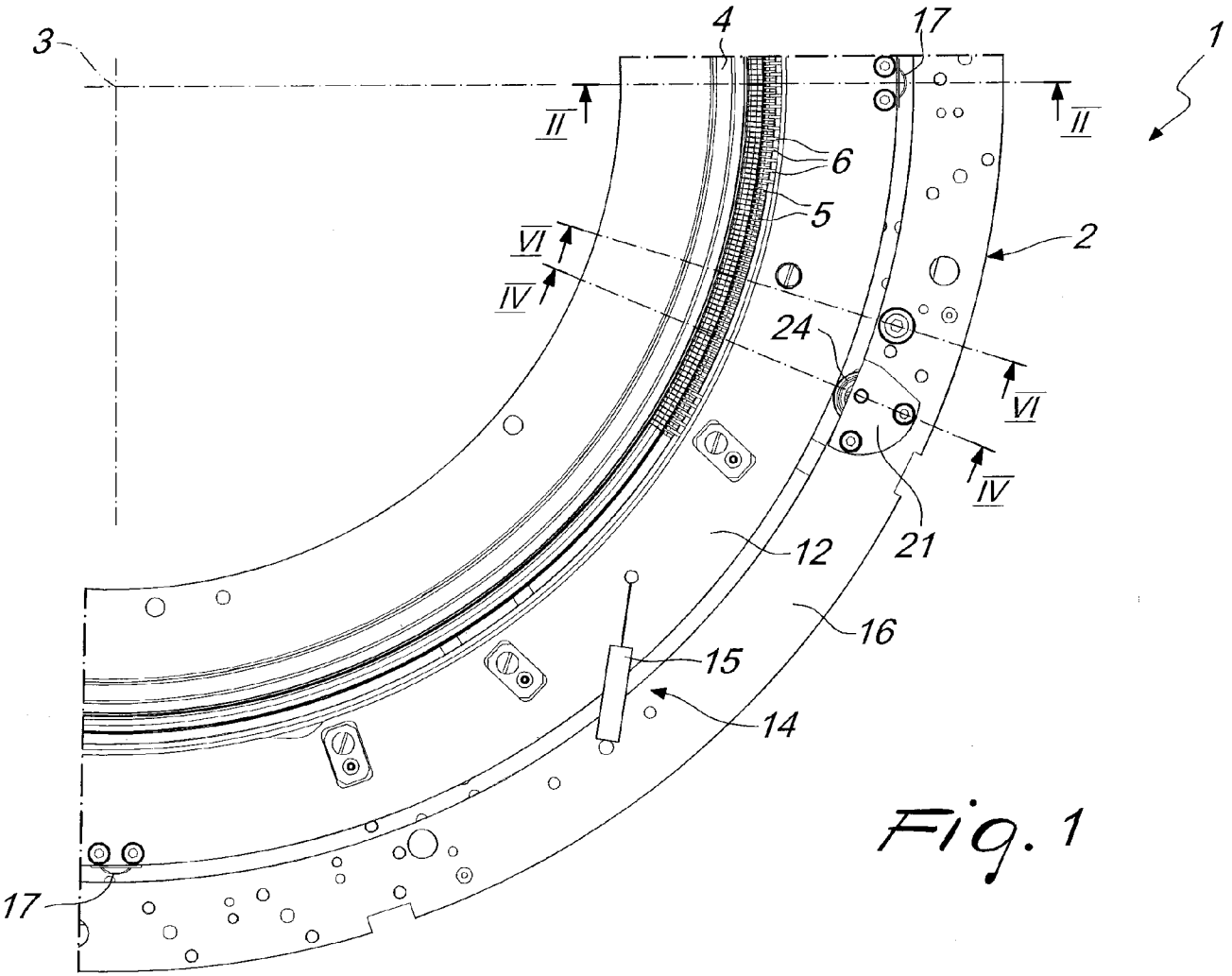
FIGS. 1 to 6 are schematic views of the machine according to the invention in the first embodiment, more precisely.
Figure 2:
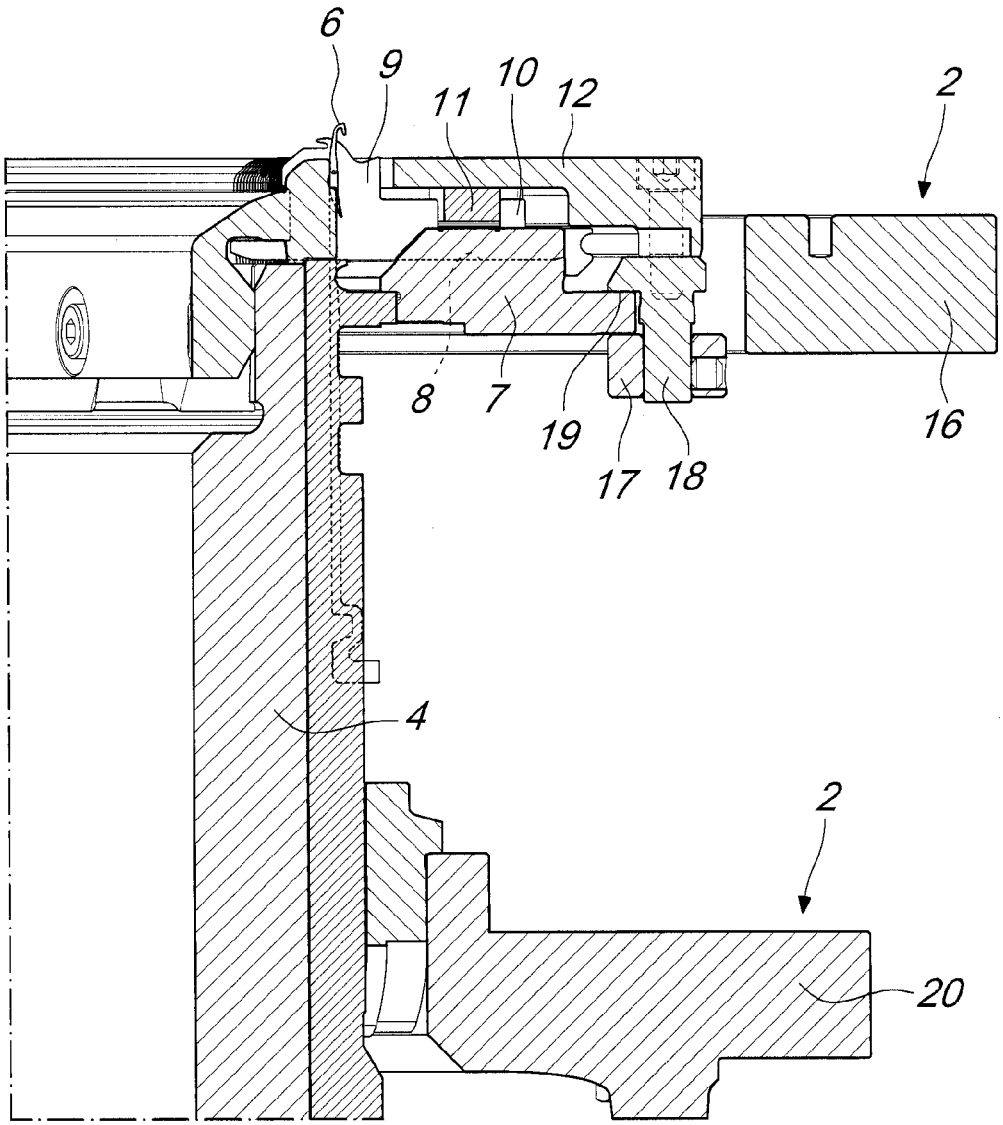
Figure 3:
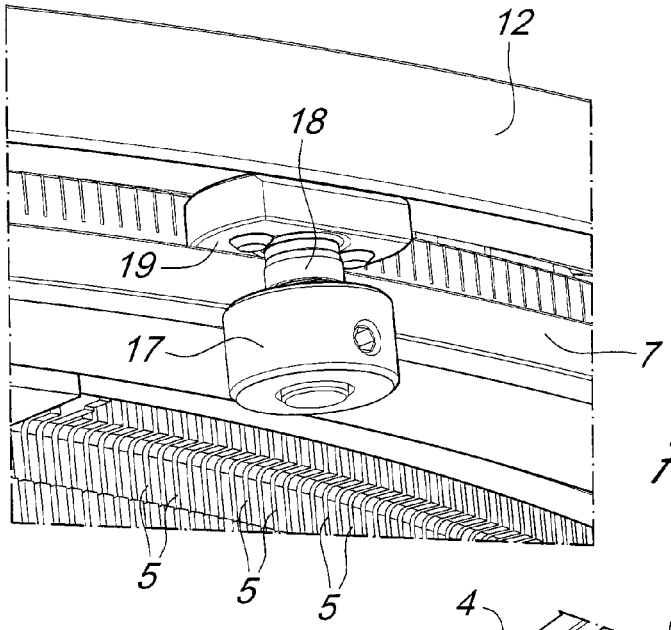
Figure 5:
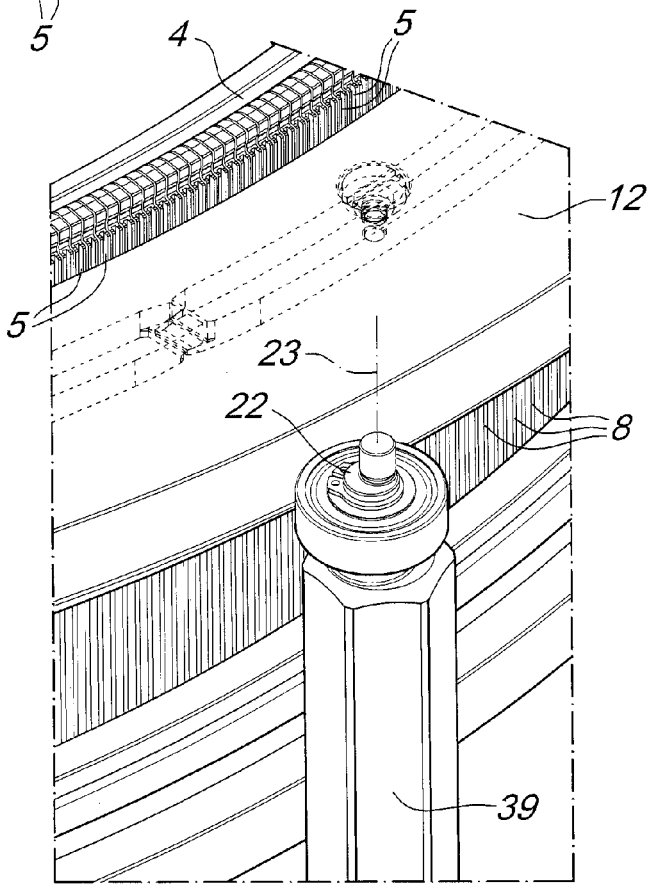
Figure 4:
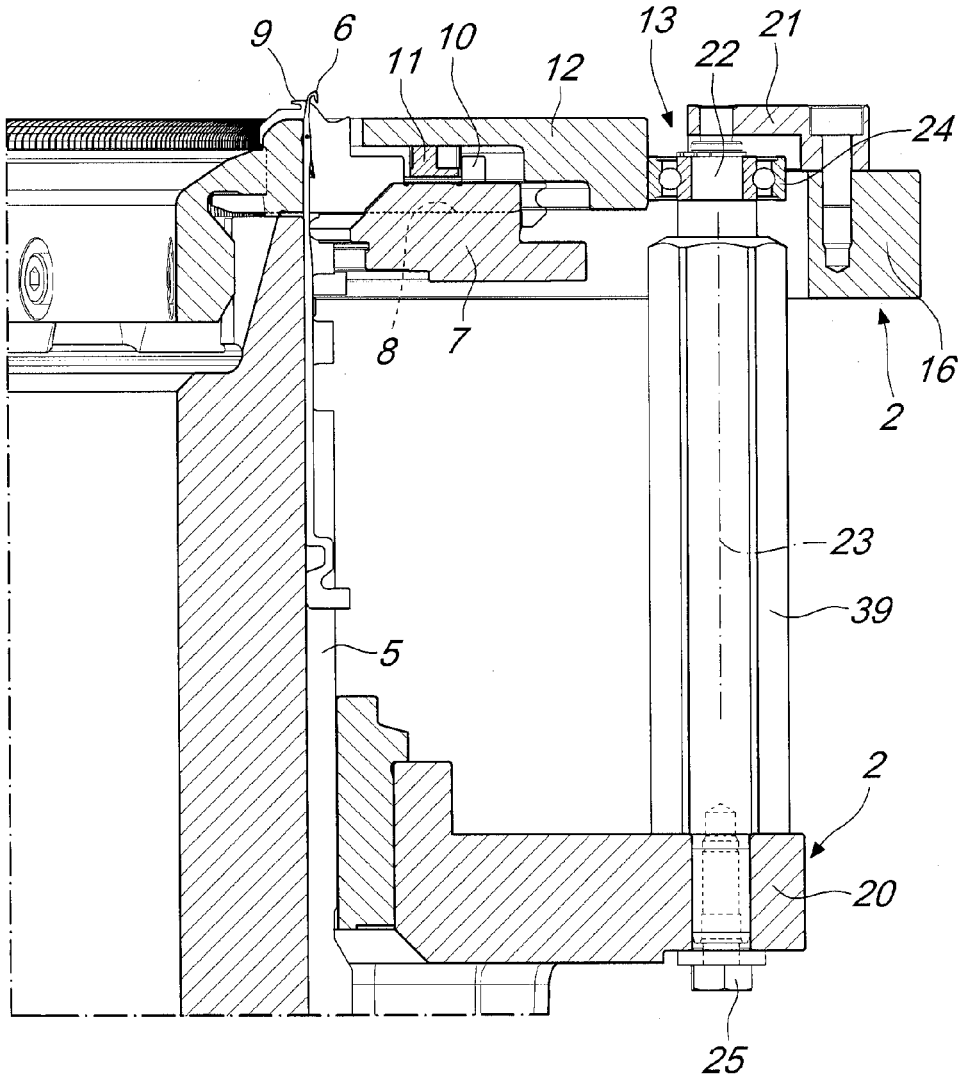
Figure 6:
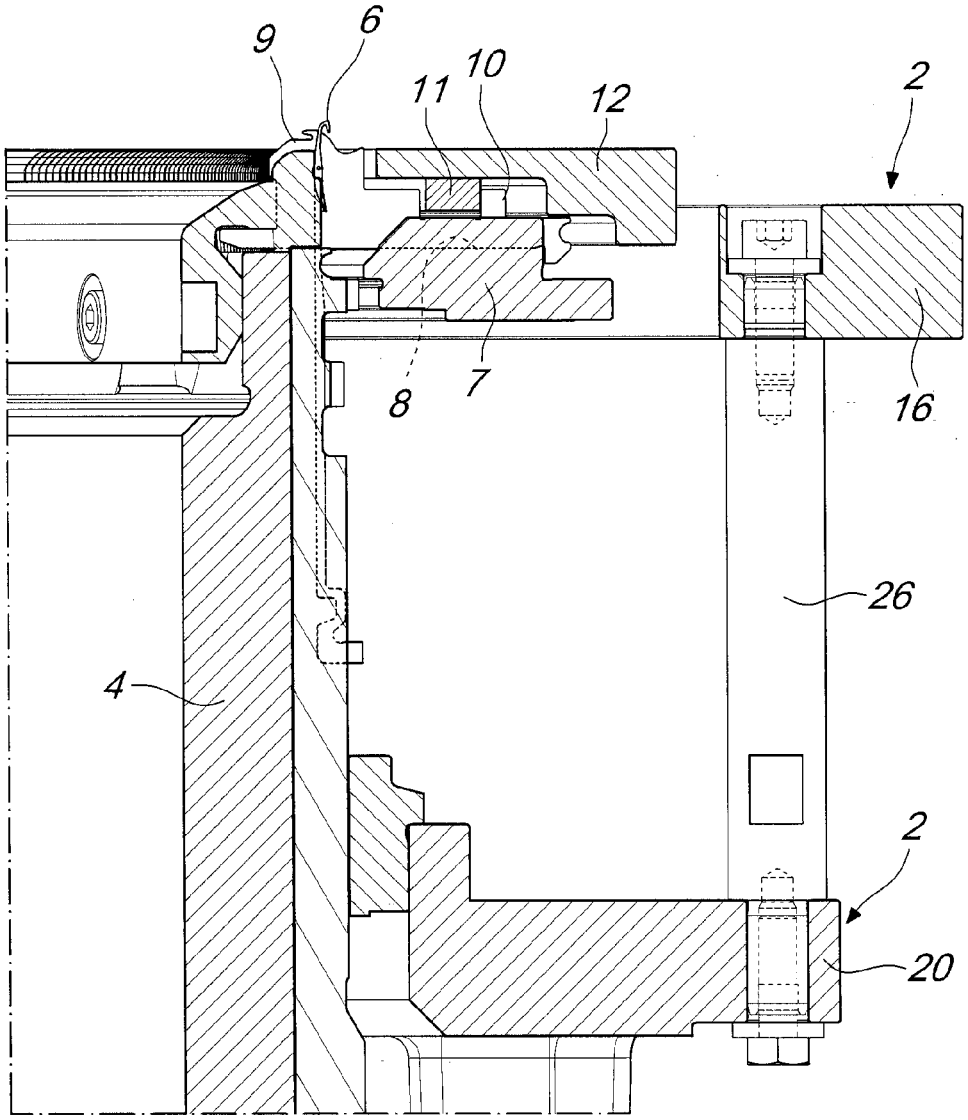
Figure 7:
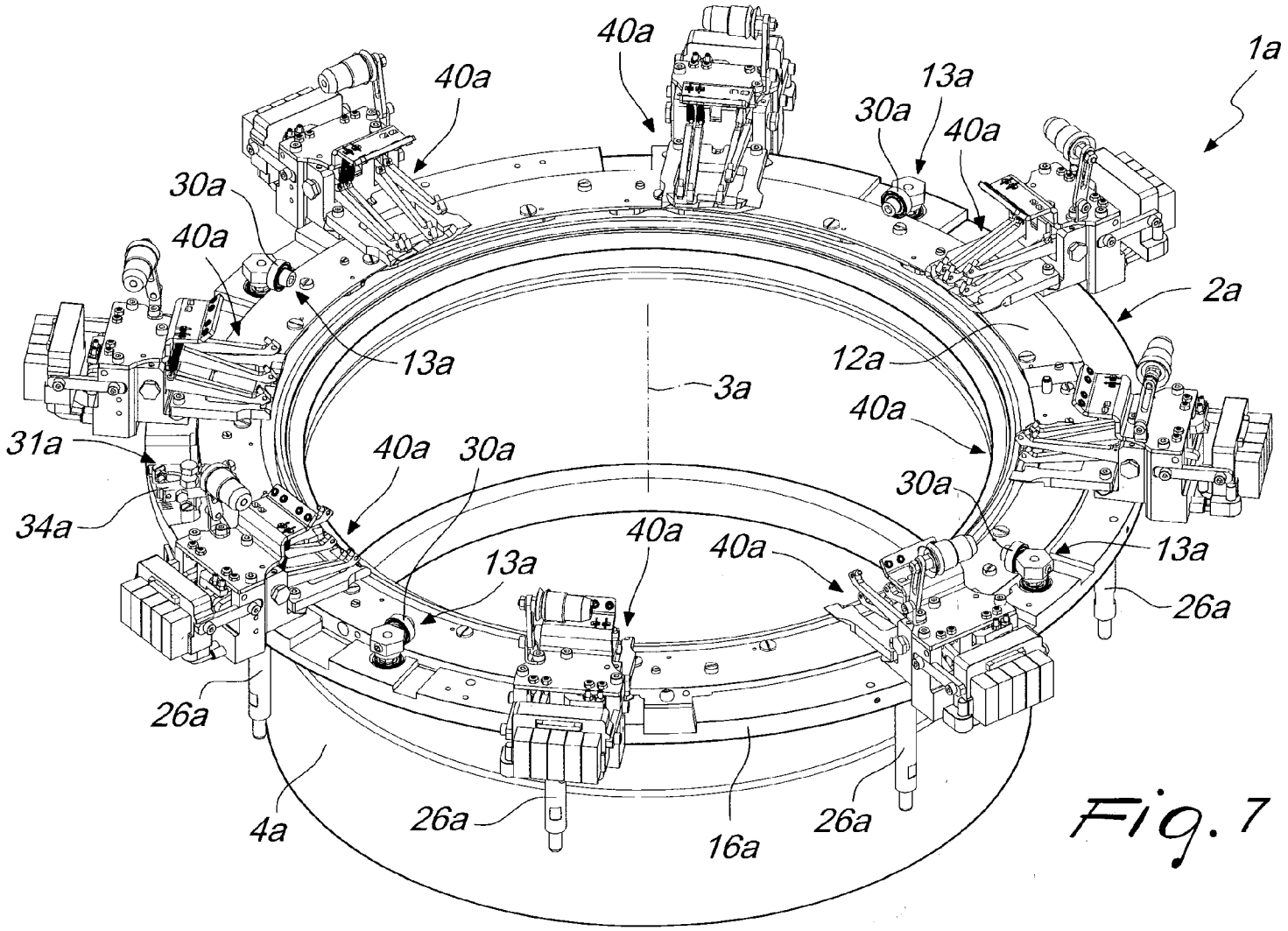
FIGS. 7 to 13 are schematic views of the machine according to the invention in the second embodiment, more precisely.
Figure 8:
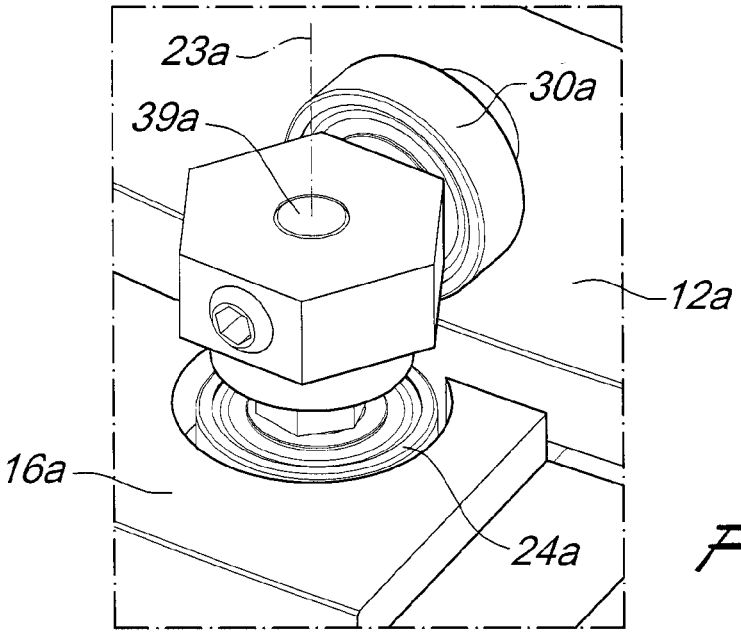

With reference to the figures, the machine according to the invention, shown only partially for the sake of simplicity and generally designated in the two embodiments by the reference numerals 1, 1*a*, comprises a supporting structure 2, 2*a*, which supports, so that it can rotate about its own axis 3, 3*a*, which is oriented vertically, a needle cylinder 4, 4*a*.

The machine 1, 1*a* according to the invention is constituted by a circular hosiery knitting machine with a diameter of the needle cylinder 4, 4*a* which is substantially comprised between 2 inches and 6 inches or by a circular knitting machine of the seamless type, with a needle cylinder diameter substantially comprised between 7 inches and 24 inches.

On the lateral surface of the needle cylinder 4, 4*a* a plurality of axial slots 5, 5*a* is provided, each of which accommodates a needle 6, 6*a* which can be actuated, in a per se known manner, with a reciprocating motion along the corresponding axial slot 5, 5*a* in order to form knitting.

Around the upper end of the needle cylinder 4, 4*a* a sinker ring 7, 7*a* is provided, which is coaxial to the needle cylinder 4, 4*a* and is integral therewith in rotation about its axis 3, 3*a*. In the sinker ring 7, 7*a* a plurality of radial slots 8, 8*a* is provided, each of which accommodates a knockover sinker 9, 9*a*, referenced hereinafter as sinker for the sake of brevity.

The radial slots 8, 8*a* are angularly offset about the axis 3, 3*a* with respect to the axial slots 5, 5*a* so that each radial slots 8, 8*a* lies between two contiguous axial slots 5, 5*a*.

The sinkers 9, 9*a* are provided with at least one heel 10, 10*a*, which protrudes upwardly from the sinker ring 7, 7*a* and engages at least one path defined by cams 11, 11*a*, which are connected to a sinker cover 12, 12*a*. The sinker cover 12, 12*a* has an annular plan shape and is arranged above and coaxially with respect to the sinker ring 7, 7*a*.

The path defined by the cams 11, 11*a* supported by the sinker cover 12, 12*a* has portions that approach and portions that move away with respect to the axis of the sinker cover 12, 12*a*, so as to cause, as a consequence of the rotation of the sinker ring 7, 7*a* jointly with the needle cylinder 4, 4*a* about the axis 3, 3*a*, with respect to the sinker cover 12, 12*a*, the reciprocating movement of the sinkers 9, 9*a* along the corresponding radial slot 8, 8*a*, which, by way of this motion, assist the needles 6, 6*a* in forming the stitches, as already explained above.

The needle cylinder 4, 4*a* can be actuated, in a per se known manner, with a rotary motion about its own axis 3, 3*a* jointly with the sinker ring 7, 7*a* with respect to the supporting structure 2, 2*a* and to the sinker cover 12, 12*a*.

The machine according to the invention comprises means 13, 13*a* for adjusting the position of the sinker cover 12, 12*a* on a plane that is substantially perpendicular to the axis 3, 3*a* of the needle cylinder 4, 4*a*, and such adjustment means 13, 13*a* are interposed between the sinker cover 12, 12*a* and the supporting structure 2, 2*a*. In this manner, the adjustment of the position of the sinker cover 12, 12*a* is performed by having as a reference the supporting structure 2, 2*a*, which is a fixed element, and therefore higher adjustment precision is achieved by improving the precision in the actuation of the sinkers 9, 9*a* and consequently the quality of the knitting.

In the first embodiment, the sinker cover 12 is supported by the needle cylinder 4 and can rotate on command, in a manner similar to what occurs in conventional circular hosiery knitting machines of the seamless type, about its own axis, which, when the sinker cover 12 is centered correctly, coincides with the axis 3, with respect to the supporting structure 2.

Conveniently, means for varying the angular position 14 of the sinker cover 12 about the axis 3 of the needle cylinder 4 with respect to the supporting structure 2 are provided.

The means 14 for varying the angular position of the sinker cover 12 can be constituted by actuators of a known type, such as for example a step motor, which is mounted on the supporting structure 2 and actuates a gear which meshes with a toothed sector which is fixed to a peripheral region of the sinker cover 12, or, as indicated schematically in FIG. 1, by a fluid-operated cylinder 15, which is connected by means of its body to a supporting ring 16, which is fixed to the supporting structure 2 and is connected, by means of the stem of its piston, to a region of the sinker cover 12, or by other mechanical or electrical actuators of a known type.

In the first embodiment, the sinker cover 12 rests on the sinker ring 7, optionally with the interposition of bearings, which are not visible in the figures, and is locked axially with respect to the sinker ring 7 by means of sealing rings 17 which face the lower face of the sinker ring 7 and are supported by pivots 18 which are integral with abutments 19 which face the upper face of the sinker ring 7 proximate to its peripheral edge. In this manner, the sinker cover 12 is coupled on both sides, along an axial direction, to the sinker ring 7, which can in any case rotate, jointly with the needle cylinder 4, about its own axis 3 with respect to the sinker cover 12.

In the first embodiment, the adjustment means 13 comprise adjustment columns 39, which have a vertical axis and are spaced angularly from each other around the axis 3 of the needle cylinder 4 and are fixed, by means of their lower end, to a lower annular element 20, which is arranged around the needle cylinder 4 and is fixed to the supporting structure 2.

Each adjustment column 39 is connected, by means of its upper end, to a support 21, which is fixed to the supporting ring 16.

The adjustment columns 39 have, proximate to their upper end, a portion 22 thereof which is eccentric with respect to the axis 23 of the adjustment columns 39. A bearing 24 is mounted around the eccentric portion 22, and the adjustment column 39 makes contact, by means of the bearing, with a portion of the lateral surface of the sinker cover 12.

In practice, in order to adjust the position of the sinker cover 12 on a plane which is perpendicular to the axis 3 of the needle cylinder 4, the adjustment columns 39 are rotated about their own axis 23 so that their eccentric portion 22, by means of the bearing 24, causes the desired movement, along a direction which is perpendicular to the axis 23 and therefore to the axis 3, of the sinker cover 12 with respect to the supporting ring 16 and therefore with respect to the supporting structure 2. Once the adjustment has been performed, the adjustment columns 39 are locked with respect to the lower annular element 20 by tightening the screw 25, which connects them to the lower annular element 20.

The supporting ring 16 is arranged around the needle cylinder 4 and can be constituted by the supporting ring of the yarn guides, which are not shown in this first embodiment and with which the machine is provided.

The supporting ring 16 is fixed to the lower annular element 20 by means of supporting columns 26, which are parallel to the adjustment columns 39.

In the second embodiment, the sinker cover 12*a* is supported by the supporting structure 2*a*.

More precisely, the sinker cover 12*a* is supported by the supporting ring 16*a* of the yarn guides 40*a* of the machine which, in turn, is supported by the supporting structure 2*a*.

The supporting ring 16*a* is fixed to the upper end of supporting columns 26*a*, which have a vertical axis and are angularly mutually spaced around the axis 3*a* of the needle cylinder 4*a*. The lower end of the supporting columns 26*a* is fixed, by means of screws 25*a*, to a lower annular element 20*a*, which surrounds the needle cylinder 4*a* and is fixed to the supporting structure 2*a*. The upper end of the supporting columns 26*a* is fixed to the supporting ring 16*a* by means of others screws 27*a*.

The means 13*a* for adjusting the position of the sinker cover 12*a* on a plane which is perpendicular to the axis 3*a* of the needle cylinder 4*a*, in the second embodiment, comprise adjustment columns 39*a*, which have a vertical axis 23*a* and are angularly mutually spaced around the axis 3*a* of the needle cylinder 4*a* and are fixed to the supporting ring 16*a* by means of a nut 28*a* which is screwed onto their lower end.

Each one of the adjustment columns 39*a* has, along its extension, a portion 22*a* which is eccentric with respect to the axis 23*a* and on which a bearing 24*a* is fitted. By means of the bearing 24*a*, the adjustment column 39*a* makes contact with a region of the outer lateral surface of the sinker cover 12*a*.

In order to adjust the sinker cover 12*a* on a plane which is perpendicular to the axis 3*a* of the needle cylinder 4*a*, the adjustment columns 39*a* are rotated about their axis 23*a* so that their eccentric portion 22*a*, by means of the bearing 24*a*, causes the desired movement, along a direction which is perpendicular to the axis 23*a* and therefore to the axis 3*a*, of the sinker cover 12*a* with respect to the supporting ring 16*a* and therefore with respect to the supporting structure 2*a*. Once the adjustment has been performed, the adjustment columns 39*a* are locked with respect to the supporting ring 16*a* by tightening the nut 28*a*.

The sinker cover 12*a* is locked axially with respect to the supporting ring 16*a*. More precisely, the sinker cover 12*a* rests, with its lower face, on the supporting ring 16*a* and each one of the adjustment columns 39*a* supports, by means of a pivot 29*a* whose axis is oriented radially with respect to the axis 3*a*, a bearing 30*a*, which rests against the upper face of the sinker cover 12*a*, preventing it from being able to rise with respect to the supporting ring 16*a*.

In the second embodiment also, the machine according to the invention comprises means for varying the angular position 14*a* of the sinker cover 12*a* about the axis 3*a* of the needle cylinder 4*a* with respect to the supporting structure 2*a*.

The angular position varying means 14*a* comprise stop abutments 31*a* with adjustable position, which are interposed between the sinker cover 12*a* and the supporting structure 2*a*. More precisely, the stop abutments 31*a* comprise screws 32*a*, 33*a*, which are connected to the two opposite sides of an arm 34*a* which is fixed to the sinker cover 12*a* and is oriented radially with respect to the axis 3*a*.

Figure 10:
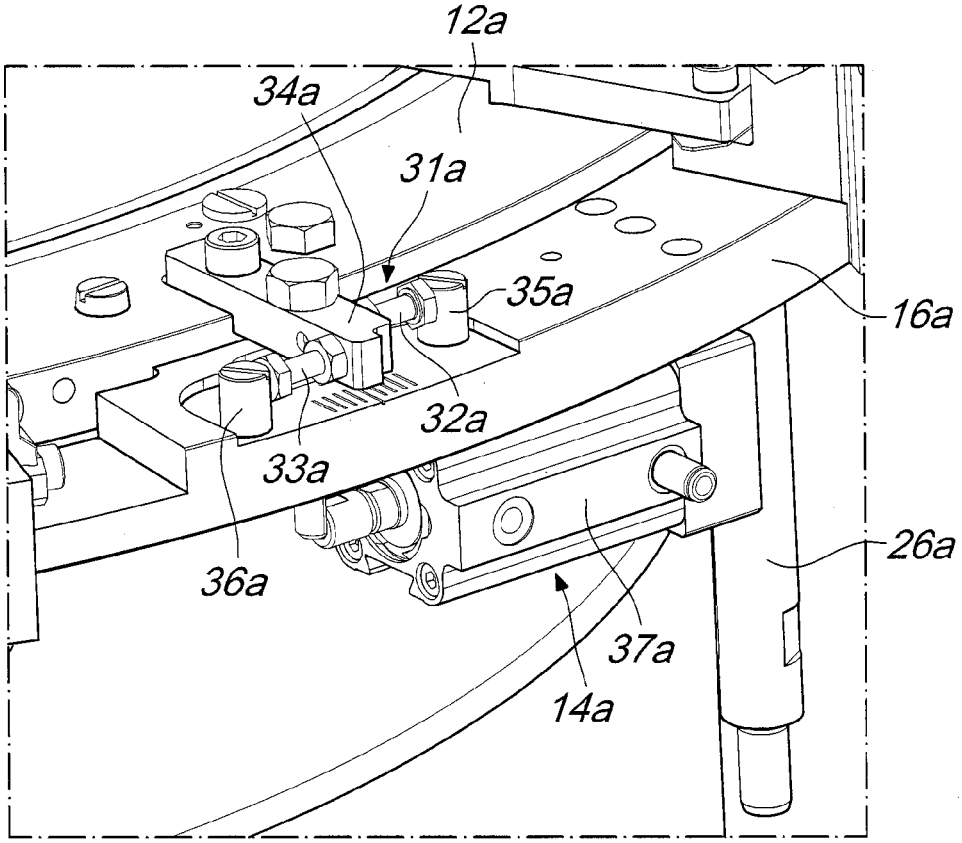
Figure 9:
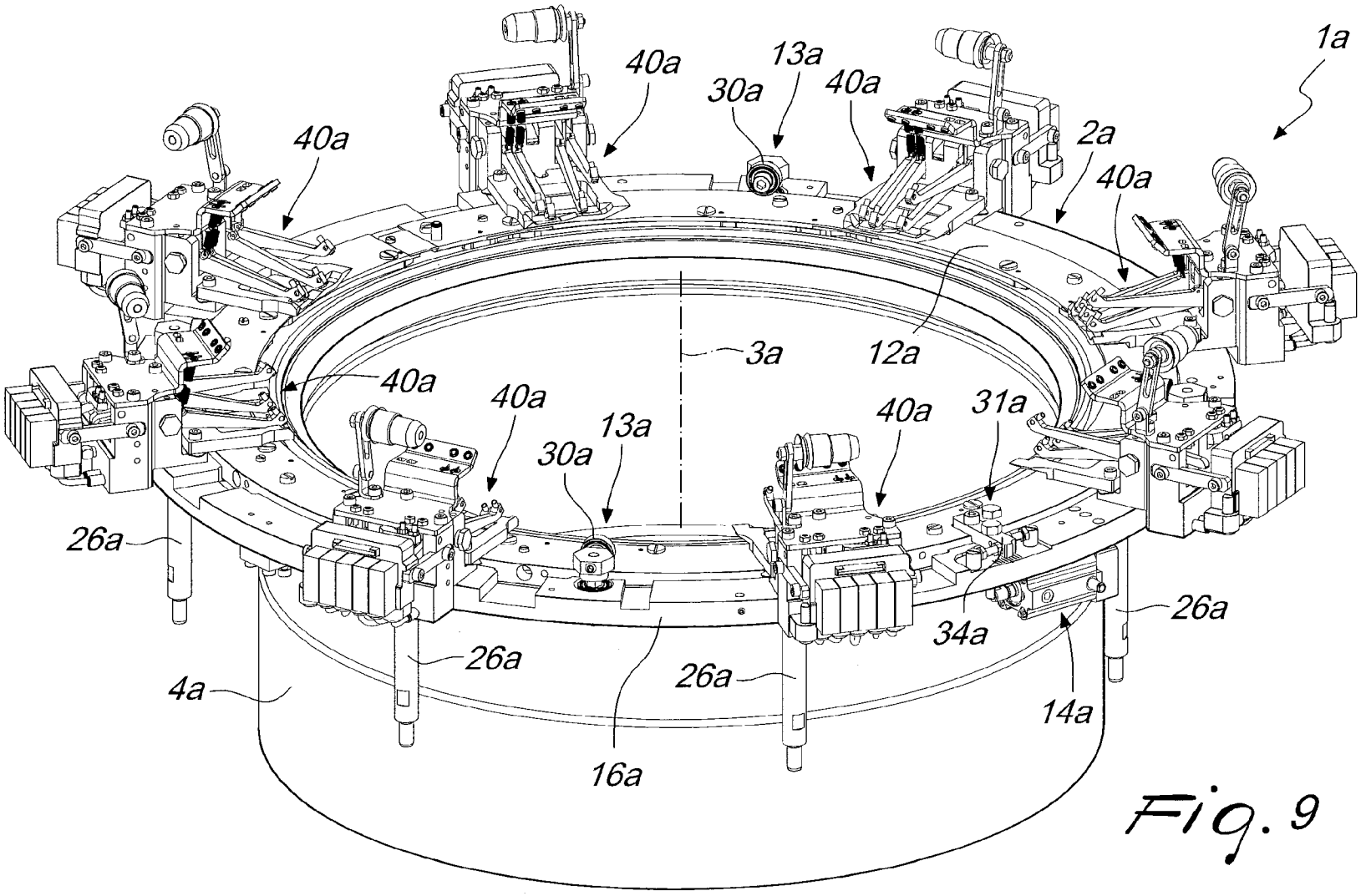
Figure 11:
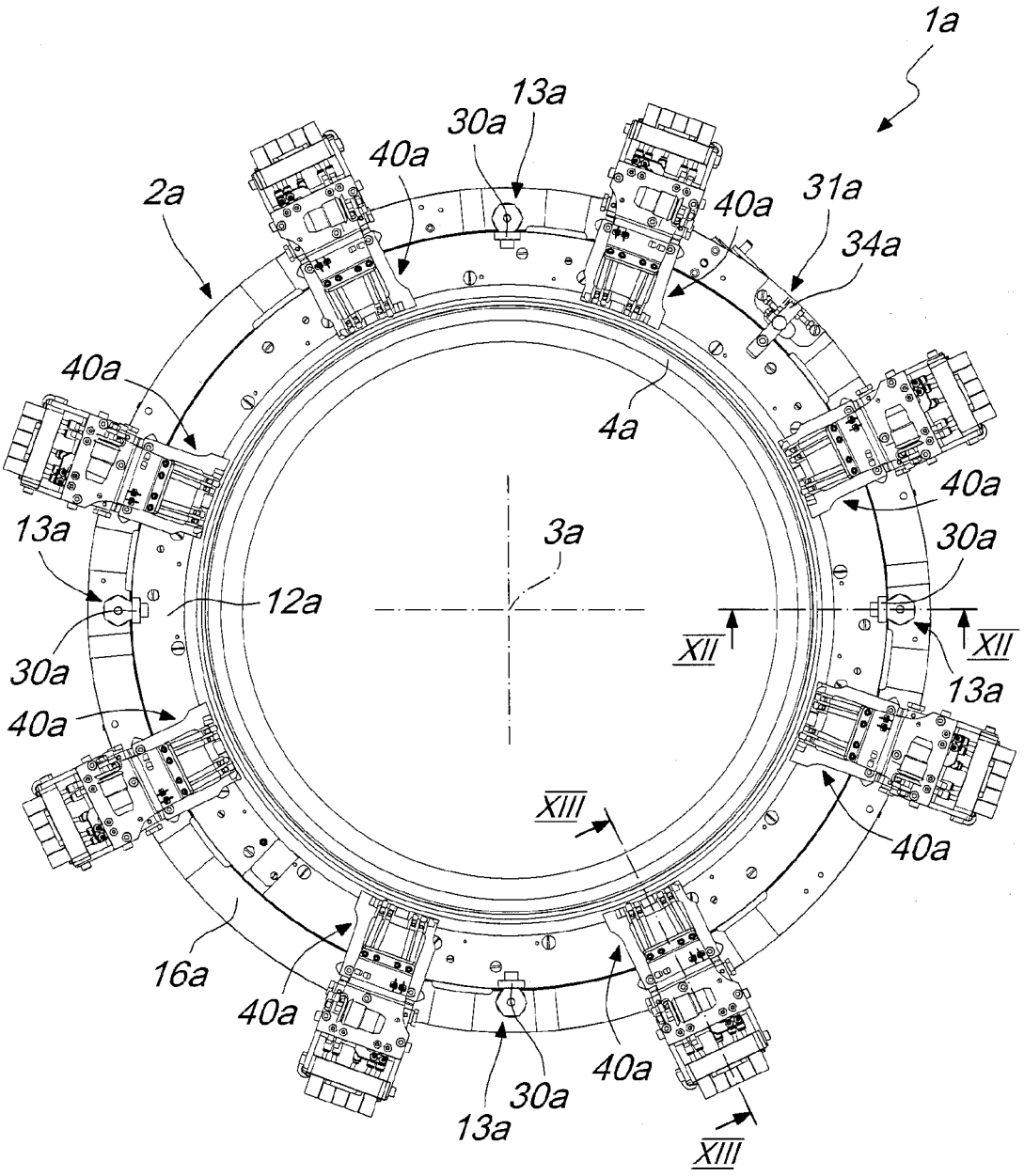
Figure 12:
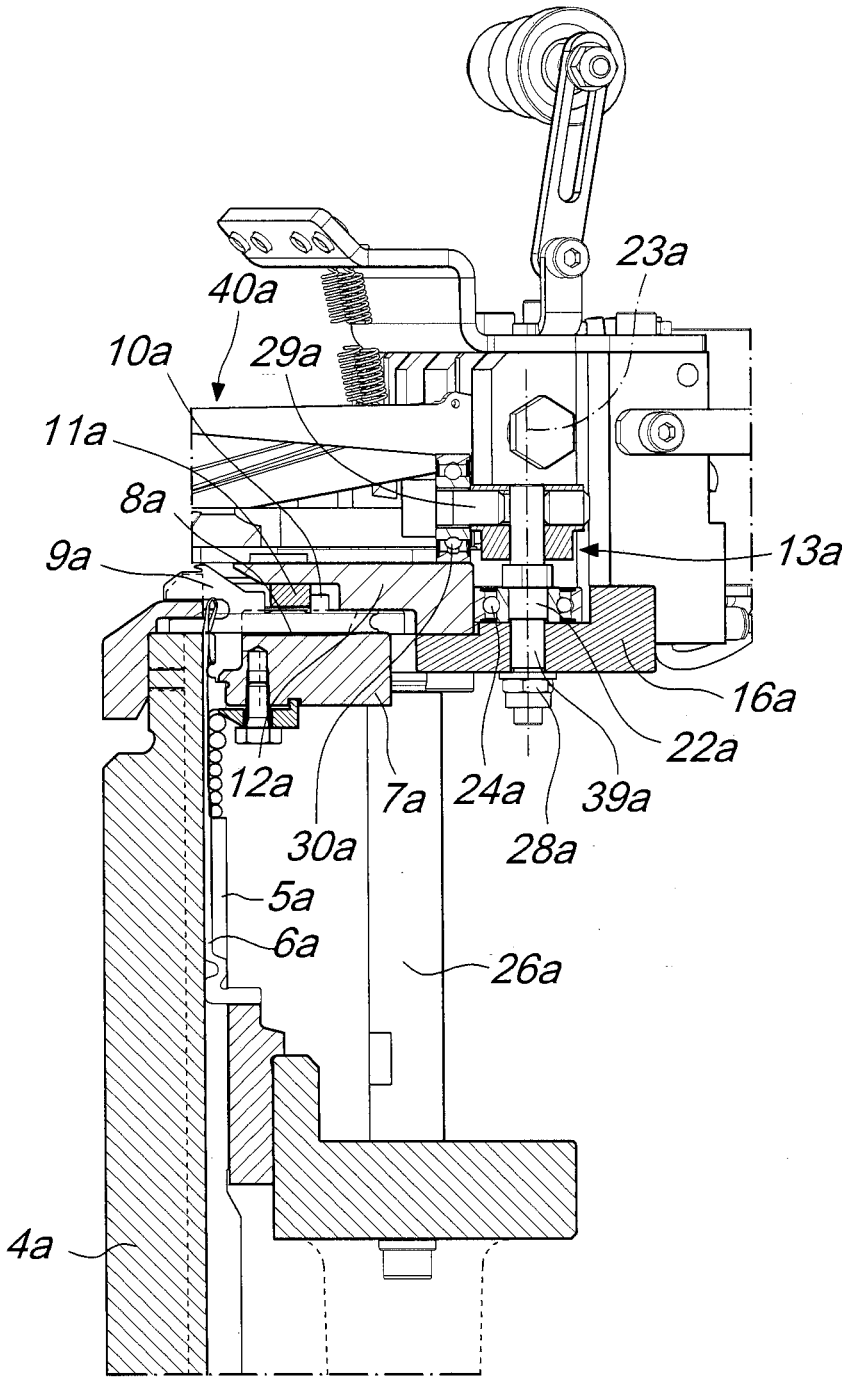
Figure 13:
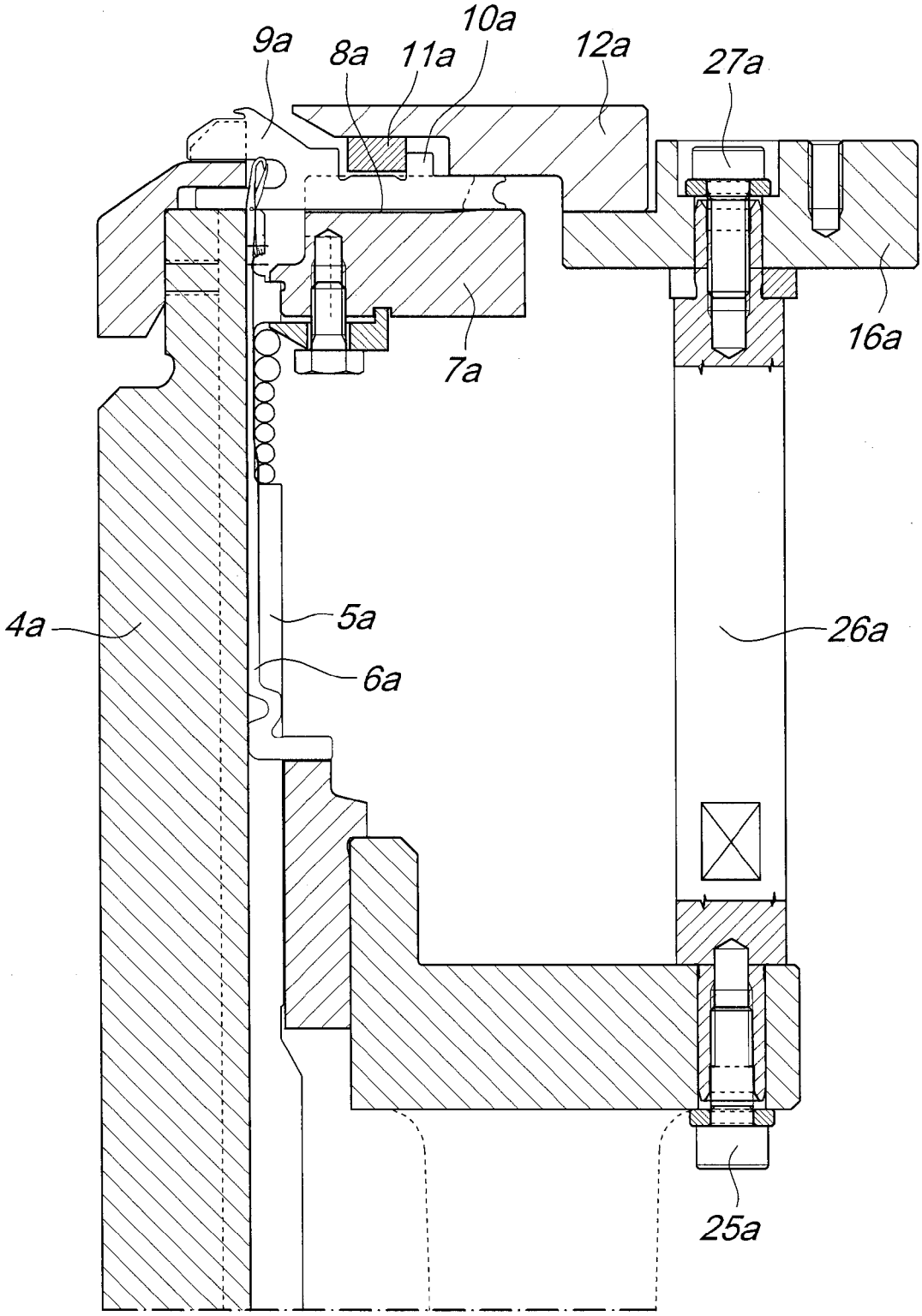

The screws 32*a*, 33*a* face pins 35*a*, 36*a*, which are fixed to the supporting ring 16*a*. By screwing or unscrewing the screws 32*a*, 33*a*, i.e., by varying their portion that protrudes from the arm 34*a* and engages against the corresponding pin 35*a*, 36*a*, the angular position of the sinker cover 12*a* around the axis 3*a* with respect to the supporting structure 2*a* and to the needle cylinder 4*a* is varied, as shown in particular in FIG. 10.

The variation of the angular position of the sinker cover 12*a* around the axis 3*a* can be performed manually by screwing or unscrewing the screws 32*a*, 33*a* which rest against the corresponding pins 35*a*, 36*a* until the desired position is achieved, or can be performed in an automated manner by means of an actuator 37*a* which is interposed between the supporting structure 2*a* and the sinker cover 12*a* and can be actuated in order to produce a rotation of the sinker cover 12*a* about the axis 3*a* with respect to the supporting structure 2*a* according to an angle of preset breadth.

In the embodiment shown in FIGS. 7 to 13, the actuator 37*a* is constituted by a fluid-operated actuator, which is connected by means of its own body to the supporting ring 16*a* and by means of the shank of its piston to the sinker cover 12*a*, but other types of actuator, for example of the known mechanical or electromechanical type, can be used.

If an actuator 37*a* is used, it is in any case possible to provide stop abutments 31*a*, which comprise screws 32*a*, 33*a* and pins 35*a*, 36*a* as already described. In this case, however, the screws 32*a*, 33*a* and the pins 35*a*, 36*a*, instead of performing the function of maintaining, once adjusted, the position of the sinker cover 12*a*, preventing its rotation about the axis 3*a* with respect to the supporting structure 2*a*, perform the function of limiting the arc of the rotation of the sinker cover 12*a* about the axis 3*a* with respect to the supporting structure 2*a* which is caused by the actuation of the actuator 37*a*, which can occur also during the operation of the machine, i.e., with the needle cylinder 4*a* rotating about its own axis 3*a* with respect to the supporting structure 2*a* of the machine, of the actuator 37*a*.

Substantially, in the machine according to the invention the adjustment of the position of the sinker cover 12, 12*a* on a plane which is substantially perpendicular to the axis 3, 3*a* of the needle cylinder 4, 4*a*, instead of being performed with respect to the needle cylinder 4, 4*a*, is performed, by means of the adjustment columns 39, 39*a* and the corresponding eccentric portions 22, 22*a*, with respect to a fixed reference system, which is constituted by the supporting structure 2, 2*a* of the machine. In this manner, the position of the sinker cover 12, 12*a* is not affected by the vibrations, thermal variations and deformations of the needle cylinder 4, 4*a* that can occur during the operation of the machine.

In practice it has been found that the machine according to the invention fully achieves the intended aim, since the adjustment of the position of the sinker cover on a plane which is substantially perpendicular to the needle cylinder axis, performed with respect to the supporting structure, makes it possible to obtain and maintain, with high precision, the correct position of the sinker cover and therefore of the sinker actuation cams. This higher precision leads to higher precision in knitting and consequently to a higher quality of the finished product.

The machine thus conceived is susceptible of numerous modifications and variations, all of which are within the scope of the appended claims. All the details may further be replaced with other technically equivalent elements.

In practice, the materials used, as well as the dimensions, may be any according to requirements and to the state of the art.

The disclosures in Italian Patent Application No. MI2011A000315 from which this application claims priority are incorporated herein by reference.

The invention claimed is:

1. A circular hosiery knitting machine of the seamless type, comprising a supporting structure and a needle cylinder which is oriented so that its axis is substantially vertical and is provided, on its lateral surface, with a plurality of axial slots, each of which accommodates a needle which can be actuated with a reciprocating motion along the corresponding axial slot; a sinker ring being arranged around the upper end of said needle cylinder, being coaxial to said needle cylinder and being provided with a plurality of radial slots, each of which accommodates a sinker, which can move with a reciprocating motion along the corresponding radial slot; each sinker being provided with a heel which protrudes upward from the corresponding radial slot and can engage at least one path defined in a sinker cover which faces in an upper region said sinker ring; said needle cylinder being actuatable with a rotary motion about its own axis with respect to said supporting structure and to said sinker cover, comprising means for adjusting the position of said sinker cover on a plane which is substantially perpendicular to the axis of said needle cylinder, said adjustment means being interposed between said sinker cover and said supporting structure.

2. The machine according to claim 1, wherein said sinker cover can rotate on command with respect to said supporting structure about the axis of said needle cylinder.

3. The machine according to claim 1, further comprising means for varying the angular position of said sinker cover around the axis of said needle cylinder with respect to said supporting structure.

4. The machine according to claim 1, wherein said sinker cover is supported by said needle cylinder.

5. The machine according to claim 1, wherein said sinker cover is supported by said supporting structure.

6. The machine according to claim 1, wherein said sinker cover is supported by a supporting ring of thread guides, which is connected to said supporting structure.

7. The machine according to claim 1, wherein said means for adjusting the position of said sinker comprise adjustment columns, which are mutually spaced angularly around the axis of said needle cylinder and are each interposed, with an eccentric portion thereof, between a portion of the outer lateral surface of said sinker cover and a portion of said supporting structure; said adjustment columns being rotatable about their own axis, which is oriented parallel to the axis of said needle cylinder, for a movement of said sinker cover with respect to said supporting structure on a plane which is perpendicular to the axis of said needle cylinder.

8. The machine according to claim 3, wherein said means for varying the angular position of said sinker cover comprise stop abutments with adjustable position, which are interposed between said sinker cover and said supporting structure.

9. The machine according to claim 1, wherein said means for varying the angular position of said sinker cover comprise an actuator, which is interposed between said supporting structure and said sinker cover and can be actuated in order to actuate a rotation of said sinker cover about said axis of the needle cylinder with respect to said supporting structure through an angle of preset breadth.

* * * * *